US007311234B2

(12) United States Patent
Solberg

(10) Patent No.: US 7,311,234 B2
(45) Date of Patent: Dec. 25, 2007

(54) VECTORED AIR WEB HANDLING APPARATUS

(75) Inventor: Bruce Jerome Solberg, Green Bay, WI (US)

(73) Assignee: The Procter & Gamble Company, Cincinnati, OH (US)

( * ) Notice: Subject to any disclaimer, the term of this patent is extended or adjusted under 35 U.S.C. 154(b) by 283 days.

(21) Appl. No.: 11/145,623

(22) Filed: Jun. 6, 2005

(65) Prior Publication Data

US 2006/0278360 A1 Dec. 14, 2006

(51) Int. Cl.
*B65H 20/00* (2006.01)
*B65H 23/24* (2006.01)

(52) U.S. Cl. ..... 226/97.3; 226/193; 242/615.12

(58) Field of Classification Search ..... 242/615.11, 242/615.12; 226/97.1, 97.2, 97.3, 190, 193
See application file for complete search history.

(56) References Cited

U.S. PATENT DOCUMENTS 2,753,181 A * 7/1956 Anander ..... 226/95
3,097,971 A * 7/1963 Carlisle et al. ..... 134/15
3,127,080 A * 3/1964 Allender et al. ..... 242/615.12
3,231,165 A * 1/1966 Wallin et al. ..... 242/615.11
3,567,093 A * 3/1971 Johnson ..... 242/615.12
3,918,706 A * 11/1975 Craft ..... 271/250
3,950,988 A 4/1976 Nowisch et al.
3,957,187 A * 5/1976 Puigrodon ..... 226/7
3,960,303 A 6/1976 Gatti et al.
4,043,495 A 8/1977 Sander
4,055,003 A 10/1977 Sack
4,074,841 A 2/1978 Kramer et al.
4,109,520 A 8/1978 Eriksson
4,197,972 A 4/1980 Daane
4,197,973 A 4/1980 Daane
4,201,323 A 5/1980 Stibbe et al.
4,288,015 A * 9/1981 Curtin ..... 242/615.12
4,308,984 A 1/1982 Vits
4,400,846 A 8/1983 Sanderson
4,403,495 A 9/1983 Talbot
4,425,719 A 1/1984 Klein et al.
4,464,143 A 8/1984 Bowyer
4,492,328 A 1/1985 Münnich et al.
4,641,214 A * 2/1987 Imanishi et al. ..... 360/130.24
4,718,178 A 1/1988 Whipple
4,785,986 A 11/1988 Daane et al.
4,790,468 A * 12/1988 Nakashima et al. ... 242/615.11

(Continued)

FOREIGN PATENT DOCUMENTS

DE 40 05 707 A1 8/1991

(Continued)

*Primary Examiner*—Peter M. Cuomo
*Assistant Examiner*—Evan H. Langdon
(74) *Attorney, Agent, or Firm*—Peter D. Meyer; Betty J. Zea; David M. Weirich

(57) ABSTRACT

A web control device is provided as a generally cylindrical hollow bar having a plurality of holes disposed thereon. Each of the plurality of holes is capable of providing fluid contact between the central portion and the outer portion of web control device. The web control device provides contact-less support of a moving web material and can reduce the Poisson lateral contraction in a moving and/or tensioned web material without wrinkling or significantly stretching the moving web material.

15 Claims, 5 Drawing Sheets

U.S. PATENT DOCUMENTS 4,819,928 A 4/1989 Osborn et al.
4,836,429 A 6/1989 Nakashima et al.
4,901,449 A 2/1990 Wimberger
4,913,329 A 4/1990 Cahill et al.
4,919,319 A 4/1990 Ford et al.
5,020,381 A 6/1991 Bartlett
5,022,166 A 6/1991 Nguyen et al.
5,052,233 A 10/1991 Rantala
5,070,628 A 12/1991 Zagar
5,092,059 A 3/1992 Wimberger et al.
5,102,118 A 4/1992 Vits et al.
5,203,485 A 4/1993 Cahill et al.
5,209,387 A 5/1993 Long et al.
5,235,733 A 8/1993 Willbanks et al.
5,316,199 A * 5/1994 Hansen et al. ..... 242/615.12
5,317,817 A 6/1994 Roberts et al.
5,370,289 A 12/1994 Helms
5,452,834 A 9/1995 Mariotti et al.
5,480,085 A 1/1996 Smithe et al.
5,480,086 A 1/1996 Nakashima et al.
5,520,317 A 5/1996 Eckert et al.
5,558,263 A 9/1996 Long
5,577,294 A 11/1996 Pollock
5,593,545 A 1/1997 Rugowski et al.
5,650,214 A 7/1997 Anderson et al.
5,671,895 A 9/1997 Cederholm et al.
5,709,352 A 1/1998 Rogers et al.
5,709,389 A 1/1998 Algers et al.
5,730,389 A 3/1998 Baigiotti
5,738,760 A 4/1998 Svanqvist et al.
5,759,352 A 6/1998 Lau et al.
5,775,623 A 7/1998 Long
5,794,500 A 8/1998 Long et al.
5,803,448 A * 9/1998 Stiel et al. ..... 271/195
5,833,106 A 11/1998 Harris
5,837,910 A 11/1998 Beijbom et al.
5,868,386 A 2/1999 Stiel et al.
5,888,349 A 3/1999 Lau et al.
5,891,309 A 4/1999 Page et al.
5,906,333 A 5/1999 Fortuna et al.
5,927,203 A 7/1999 Gieser et al.
5,967,457 A 10/1999 Wildenberg et al.
5,970,627 A 10/1999 Stenz et al.
5,979,731 A 11/1999 Long et al.
6,004,432 A 12/1999 Page et al.
6,030,496 A 2/2000 Baggot et al.
6,125,754 A 10/2000 Harris
6,231,001 B1 * 5/2001 Kramer et al. ..... 242/615.11
6,302,353 B1 * 10/2001 Motegi et al. ..... 242/615.12
6,325,896 B1 12/2001 Hultcrantz et al.
6,328,852 B1 12/2001 McGary et al.
6,364,247 B1 4/2002 Polkinghorne
6,374,247 B1 4/2002 Gebauer
6,375,801 B2 4/2002 McGary et al.
6,397,495 B1 6/2002 Doherty et al.
6,427,941 B1 * 8/2002 Hikita ..... 242/615.12
6,454,903 B2 9/2002 Mohrsen et al.
6,505,792 B1 1/2003 Rocheleau et al.
6,533,217 B2 * 3/2003 Lind ..... 242/615.12
6,786,449 B2 * 9/2004 Marcle-Geler et al. 242/615.12
6,796,524 B2 * 9/2004 Pollock et al. ..... 242/615.12
6,805,318 B2 * 10/2004 Ebner ..... 242/615.11
7,025,303 B2 * 4/2006 Meyer ..... 242/615.12
7,100,864 B2 * 9/2006 Weis ..... 242/615.12
7,201,300 B2 * 4/2007 Buri et al. ..... 226/196.1
2002/0113164 A1 * 8/2002 Marcle-Geler et al. 242/615.12
2003/0146340 A1 * 8/2003 Ebner ..... 242/615.11
2005/0242229 A1 * 11/2005 Koivukunnas et al. . 242/615.12
2006/0097101 A1 * 5/2006 Boppel et al. ..... 242/615.12
2006/0278360 A1 * 12/2006 Solberg ..... 162/272
2007/0102563 A1 * 5/2007 Kubota et al. ..... 242/548

FOREIGN PATENT DOCUMENTS

DE 195 23 072 A1 1/1997
DE 201 18 991 5/2002
WO WO 02/051732 7/2002

* cited by examiner

VECTORED AIR WEB HANDLING APPARATUS

FIELD OF THE INVENTION

The present invention relates to devices for handling web materials that require support and control. In particular, the present invention relates to a device that supports a web on a cushion of air. Further, the present invention relates to devices capable of removing dust generated by a moving web in a web-handling process.

BACKGROUND OF THE INVENTION

Various devices for forming fluid cushions or fluid bearings have been used for the contactless support of a web as the latter changes directions during its course of travel. These running webs may be required to pass through a number of different processes or directed in different directions. By way of example, webs resulting from a papermaking process may be directed through contactless supporting devices to downstream converting operations to produce absorbent paper products such as diapers, facial tissues, and the like. Such contactless support devices are described as generally partially cylindrical surfaces through which pressurized air is introduced through various slots, holes, apertures, or the like.

However, it should be realized that web materials handled under such processes are generally planar with a thickness much smaller than the dimensions of the material. Such webs are likely to include paper, cloth, plastic film, woven, non-woven, and metal films. These web materials are known to present unique process challenges. For example, it is known that typical flexible web materials are easily damaged, and can result in final products that are unacceptable.

Such thin materials that are produced into wound webs are also known to have fluctuations in the wound web tension throughout the length and width of the web. Such fluctuations can be problematic as the web is unwound and transported by processing equipment during the conversion of large rolls of web material into finished products. Such web tension fluctuations may result in wrinkled, broken webs, webs of varying widths, a loss of control of the web material during processing, and ultimately provide for a loss of quality and/or productivity.

Thus, in most applications, it is desirable, if not imperative, to keep the web material from coming into direct contact with handling surfaces. The web material may be recently imprinted, and, thereby, carrying a wet image on at least one surface. Alternatively, the web material may be delicate and have a relatively low basis weight. Yet still, the web material may be wet. Therefore, preventing contact of the web material with a control surface can be beneficial, for example, if the control surface is dirty or greasy. Additionally, mechanical flaws in the surface of conventional control systems may cut or severely scar the surface of the web material. Further, it can be difficult to provide conventional web handling equipment to be surface speed matched to the speed of the web. This can be especially true if the process requires the web material speed to be variable, or if velocity fluctuations are caused by out of round or non-uniform supply rolls.

Additionally, moving and/or tensioned web materials may have inherent properties that provide additional difficulty in handling. For example, a material may have a lateral contraction when the material is subjected to an applied elongation. Such lateral contraction in a tensioned web material is known as the "Poisson lateral contraction effect." Also, it has been seen that the stress and/or strain characteristics of the web material may vary laterally to a considerable extent. This may cause one portion of the web substrate to be tight and another portion of the web substrate to be loose. Additionally, low basis weight materials, because of their ability to stretch, can easily become wrinkled as the unconstrained web material moves over traditional supports. This can lead to wrinkles in the finished product. Typically, wrinkles can lower the product functionality by reducing absorbency of cellulose-based web materials and detract from the appearance of the finished product if it is formed from tissue paper.

Previous air-driven web handling equipment has been provided to frictionlessly, aerodynamically, and/or hydrodynamically support a moving web material on a cushion of fluid, such as air or gas, as the moving web passes over the control surface. Such devices are described in U.S. Pat. Nos. 4,043,495; 4,197,972; 5,775,623; 6,004,432; and 6,505,792. However, such devices as described do not reduce the Poisson lateral contraction that inherently occurs in a moving and/or tensioned web material as it passes through a converting process. Additionally, it is possible for these described devices to utilize excessive air flows. Excessive air flow can cause loss of control of the web material due to excessive lift. Further, the described devices do not provide the ability to remove dust generated by the moving web material.

Therefore, a device that provides contactless support of a moving web material that is capable of reducing the Poisson lateral contraction in a moving and/or tensioned web material is required. Such a device would be capable of controlling or turning a web material without wrinkling or significant stretching. Further, it is also a benefit to be able to provide such a device with the ability to remove dust from the web material as the web material progress through a web handling or converting process.

SUMMARY OF THE INVENTION

The present invention relates to an apparatus for, reducing the Poisson lateral contraction in a tensioned web substrate. The apparatus comprises a surface having a machine direction, a cross-machine directional orthogonal to the machine direction, and a z-direction orthogonal to both the machine direction and the cross-machine direction. The apparatus is provided with a plurality of holes disposed upon the surface, each of the holes being operatively connected to a source of positive pressure. The holes provide fluid communication of the positive pressure through the surface to the web substrate passing proximate thereto. Each of the holes has a longitudinal axis associated thereto. The longitudinal axis of a first of the holes has a first inclination relative to the z-direction and the longitudinal axis of a second of the holes has a second inclination relative to the z-direction. Further, the first and second inclinations are different.

The present invention also relates to an apparatus for reducing the Poisson lateral contraction in a machine direction moving web substrate. The apparatus comprises a surface having a machine direction, a cross-machine directional orthogonal to the machine direction, and a z-direction orthogonal to both the machine direction and the cross-machine direction. A plurality of holes are disposed upon the surface and each hole is operatively connected to a source of positive pressure so that the holes provide a fluid communication of the positive pressure through the surface to the web substrate passing proximate thereto. Each of the holes has a longitudinal axis associated thereto and the longitudinal axis of a first of the holes has a first inclination relative to the z-direction and the longitudinal axis of a second of the holes has a second inclination relative to the z-direction. The longitudinal axis of a third of the holes has a third inclination relative to the z-direction. Further, the first and second inclinations are different. Additionally, the third hole is spaced from the first and second holes in the cross-machine direction and, the first and second inclinations are directed toward a first edge of the web substrate and the third inclination is directed toward a second edge of the web substrate.

The present invention further relates to an apparatus for reducing the Poisson lateral contraction in a machine direction moving web substrate. The apparatus comprises a surface having a machine direction, a cross-machine directional orthogonal to the machine direction, and a z-direction orthogonal to both the machine direction and the cross-machine direction. A plurality of holes are disposed upon the surface so that each of the holes is operatively connected to a source of positive pressure. The holes provide a fluid communication of the positive pressure through the surface to the web substrate passing proximate thereto. Each of the holes has a longitudinal axis associated thereto. The longitudinal axis of a first of the holes has a first inclination relative to the z-direction and the longitudinal axis of a second of the holes has a second inclination relative to the z-direction and the longitudinal axis of a third of the holes has a third inclination relative to the z-direction. The first and second inclinations are different. The third hole is spaced from the first and second holes in the machine direction and, the first, second, and third inclinations are directed toward a first edge of the web substrate.

DETAILED DESCRIPTION OF THE INVENTION

Figure 1:
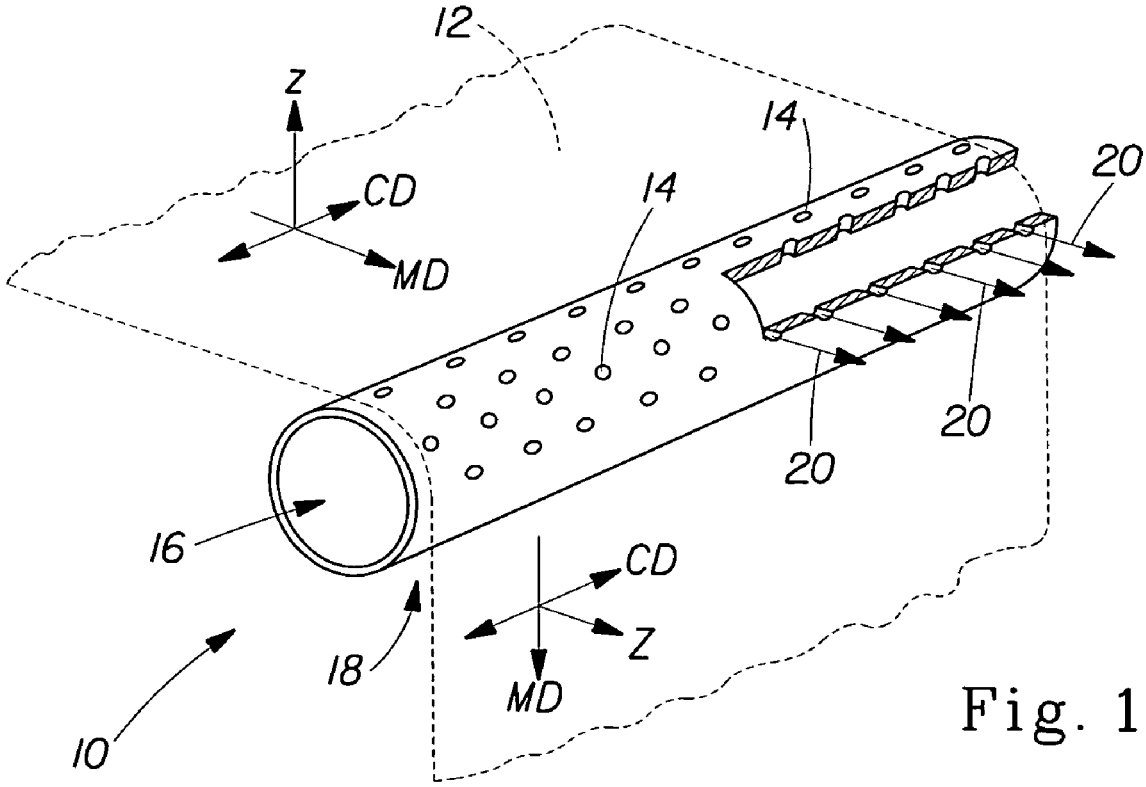
FIG. 1 is a perspective view with a partial breakaway of a web control device in accordance with the present invention.

As shown in FIG. 1, a moving web material 12 having a machine direction (MD), a cross-machine direction (CD) generally orthogonal and coplanar thereto, and a z-direction orthogonal to both the MD and CD, approaches proximate to the surface of the web control device 10. By way of example, web control device 10 can be provided as a generally cylindrical hollow bar having a plurality of holes 14 disposed thereon. Each of the plurality of holes 14 is capable of providing fluid contact between the central portion 16 and the outer portion 18 of web control device 10.

Figure 2:
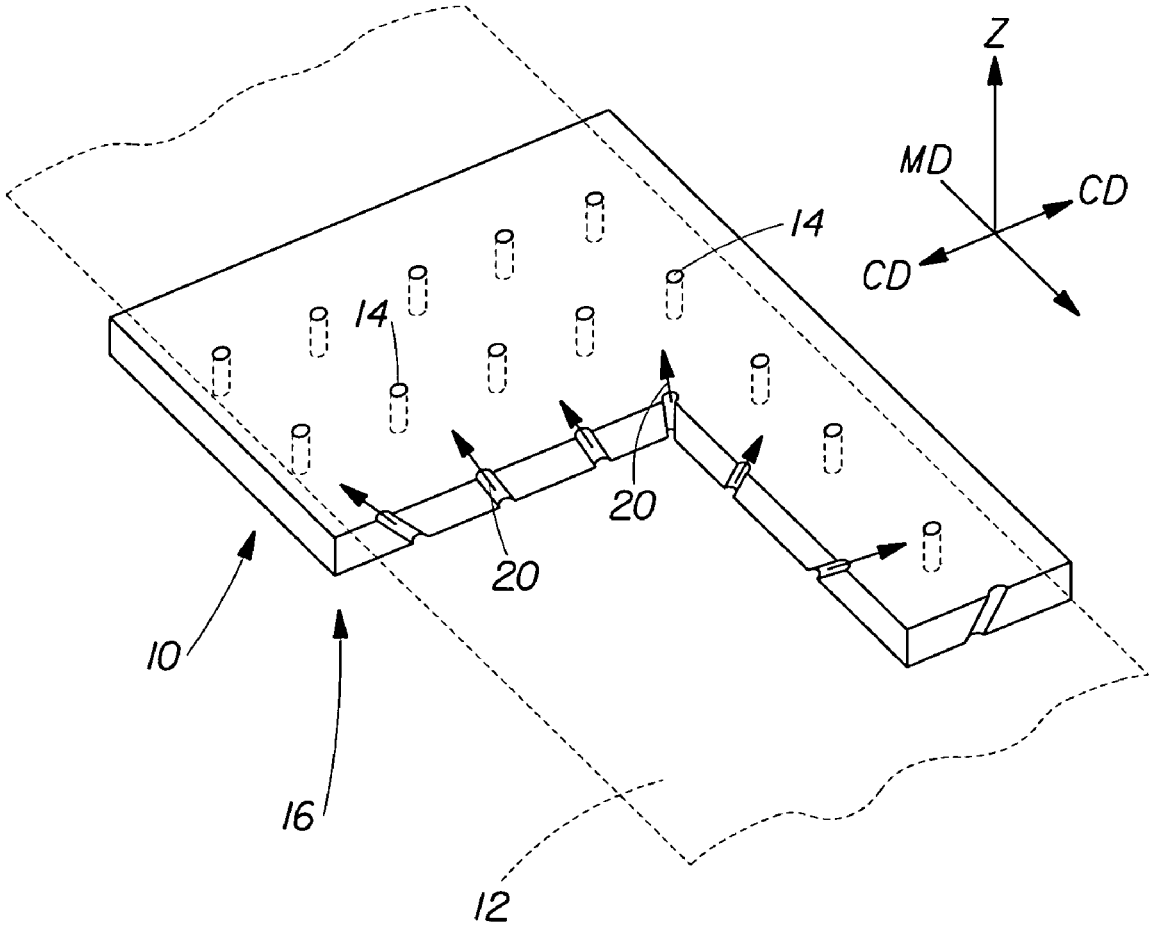
FIG. 2 is a perspective view of another embodiment of a web control device.

It would be apparent to one of skill in the art that web control device 10 can be provided in geometries other than a cylindrical hollow bar. By way of non-limiting example, FIG. 2 shows an exemplary web control device 10 in the form of a generally flat plate. Each of a plurality of holes 14 disposed upon web control device 10 is capable of providing fluid contact between opposing surfaces of the web control device 10. Such a generally flat plate web control device 10 could be attached to an air plenum, or be provided as a surface of an air plenum, in order for holes 14 to provide fluid contact of air from inside such a plenum to the outer surface of the web control device 10. Additionally, web control device 10 can manifest itself as, or be adapted to conform with, virtually any type of web handling device known to those of skill in the art including, but not limited to, folding boards, folding bars, folding rails, folding fingers, folding plows, and the like.

Returning again to FIG. 1, web material 12 is generally provided with movement in a first direction (generally, the MD) indicated by the arrow MD. As the web material 12 approaches and traverses proximate to the surface of web control device 10, web device 10 can provide web material 12 with a change in direction. Or, if desired, web control device 10 can be utilized to stabilize, remove droop, and/or provide little, if any, change in direction to web material 12 passing proximate to web control device 10 as required.

Inner portion 16 of web control device 10 can function as a central plenum that is supplied with air under pressure. Such pressurized air can be blown through holes 14 that provide fluid contact between inner portion 16 and outer portion 18 of web control device 10. Each of the plurality of holes 14 disposed in web control device 10 is provided with a longitudinal axis 20. In a preferred embodiment, the longitudinal axis 20 of each hole 14 is provided with a vector component, or inclination, relative to the z-direction of web control device 10.

Figure 3:
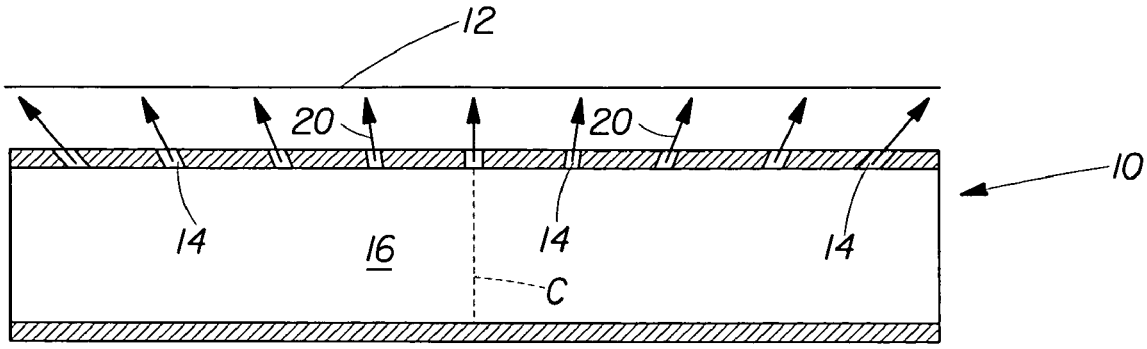
FIG. 3 is a cross-sectional view of an exemplary web control device.

As shown in the cross-section view of FIG. 3, the longitudinal axis 20 of each of the holes 14 is arranged to provide fluid contact from the inner portion 16 of the web control device 10 to the surface of web material 12 at an angle relative to the Z-direction. Preferably, the longitudinal axis 20 of each of the holes 14 has vector components relative to both the CD and z-directions. Further, in a particularly preferred embodiment, the longitudinal axis 20 of each of the holes 14 on the respective side of the center C of web control device 10 are provided with an angle having vector components relative to both the CD and z-directions from the center C of web control device 10 toward the respective edge of web control device 10 and/or web material 12.

In other words, as shown in FIG. 3, the longitudinal axis 20 of the holes 14 present on web control device 10 that are to the right of center C of the web control device 10 are angled toward the right-hand edge of the web control device 10. Similarly, the longitudinal axis 20 of the holes 14 which are disposed upon the surface of web control device 10 which are to the left of center C of the web control device 10 are angled toward the left-hand edge of the web control device 10.

In yet still another preferred embodiment, the longitudinal axis 20 of the holes 14 disposed upon a respective side of center C of web control device 10 are provided with vector components in both the CD and z-direction so that holes 14 disposed proximate to the center C of web control device 10 have a larger z-direction component than holes 14 disposed proximate to an edge of web control device 10. This means that the longitudinal axis 20 of holes 14 disposed proximate to an edge of web control device 10 have a larger CD component than holes 14 disposed proximate to the center C of web control device 10.

Thus, as can be seen in the exemplary embodiment of web control device 10 of FIG. 3, as the holes 14 progress from the center C of web control device 10 to the respective edge of web control device 10, the vector component of each longitudinal axis 20 of each hole 14 is provided with an increasing CD vector component. This provides a progressive angular appearance of the orientation of each longitudinal axis 20 of each hole 14 from the center C to the respective edge of web control device 10.

By providing such a progressive angular appearance of the orientation of each longitudinal axis 20 of each hole 14 from the center C to the respective edge of web control device 10, it is believed, without desiring to be bound by theory, that the air fluidly transmitted from the inner portion 16 through holes 14 to the surface of the web material 12 passing proximate to web control device 10, provides a spreading effect on the web material 12. This spreading effect is believed to reduce the effect of Poisson lateral contraction in the CD due to a MD tension upon web material 12 because the discharge of fluid from such a progressively angled series of holes 14 can facilitate the application of a force component on the web material 12 that is directed towards the respective edge of the web material 12. In other words any effects upon web material 12 due to a Poisson lateral contraction are counteracted to some degree by a momentum transfer from the discharged fluid to the web material 12 through viscous coupling.

Without desiring to be bound by theory, it is also believed that providing progressively angled holes 14, as described supra, can minimize strain on the web material 12. In other words, by avoiding any sudden changes in CD strain of web material 12, CD tension variations within web material 12 can be minimized. By gradually increasing the vectored angle the longitudinal axis 20 of each hole 14 from the center C of web control device 10 to a respective edge of web control device 10, a smaller and more uniform viscous force is applied to the web material 12. Forces applied to a web material 12 that has CD stress and/or strain differences, CD elastic modulus changes (i.e., stress-strain variations), CD caliper differences in web material 12, lateral differential MD unit lengths, and the like, can cause localized wrinkling in the web material 12. Thus, it is believed that such a vectored angle approach as described herein can effectively remove wrinkles present upon web material 12 that are related to such lateral contraction effects.

Further, as would be known to one of skill in the art, the number of holes 14, the apparent size of the holes 14, the air pressure provided to inner portion 16 of web control device 10, and the like, can be varied according to the porosity, density, web wrap angle, nominal tension, and other physical characteristics present in the web material 12 and by the requirements of the relevant processing system. Without desiring to be bound by theory, it is believed that the web control device 10 is capable of providing support for web material 12 as well as providing control for web material 12 because web control device 10 operates as a circular air foil. One of skill in the art will be able to utilize mathematical modeling systems to show the presence of a viscous drag upon the surface of the web control device 10 for a portion of the surface. In conventional air bar/handling devices for handling a web material, as the MD speed of web material 12 increases, the amount of air proximate to the web material 12 (i.e., the boundary air) increases, resulting in a loss of control of web material 12. Since one of skill in the art will appreciate that these conventional air bar/handling devices lose control of the web material because air reflected by the web material 12 follows the Knox-Sweeny equation. In other words, a web substrate controlled by a conventional air bar/handling device will float over the device and track to the neutral axis of the CD stress/strain characteristics of the web material. Since the CD stress/strain characteristics of the web material can changes quite dramatically (±30% normally) the web material will tend to steer from one side to another of a conventional air bar/air handling device and result in a loss of control and weave of the web material, and causing Holdovers.

Contrastingly, the vectored air handling approach as described herein can reduce the volume of fluid necessary to maintain support of a web material 12 traversing proximate web control device 10 while at the same time maintain better control of a traversing web material 12. By directing and limiting the amount of reflected air evoluted from holes 14 as described herein, the web control device 10 does not fully lift the web material 12 while providing small regions of drag disposed between each hole 14. Thus, the web material 12 tends to remain 'wetted' to the surface of web control device 10 thereby providing web control device 10 with heretofore unrealized control of a web material 12 passing proximate web control device 10.

Returning again to FIGS. 1 and 3, a preferred embodiment of the web control device 10 is depicted showing the layout of holes 14 for optimum performance for removing any effects due to Poisson lateral contraction upon a web substrate 12 passing proximate to web control device 10. A first line of circular holes 14 are preferably positioned 5-20 degrees radially from the turn entrance (and exit) of web control device 10, with the center of the first hole 14 being aligned with the centerline of web material 12. The longitudinal axis 20 of the holes 14 are preferably oriented outward towards an edge of the web control device 10 and the web material 12 passing proximate thereto so that the angle of the longitudinal axis 20 with respect to the Z-direction increases and decreases relative to the CD. In a preferred embodiment, the holes 14 range from about 0.050 inches (1.27 mm) to 0.125 inches (3.18 mm) diameter and from about 0.250 inches (6.35 mm) to 0.750 inches (19.1 mm) spacing on centers. In a preferred embodiment, a second line or row of holes 14 can be provided to run parallel to the first row in the CD and spaced from about 0.250 inches (6.35 mm) to 0.750 inches (19.1 mm) (i.e., about 10 degrees radially) from the first CD row of holes 14. Preferably, the dimensions of the holes 14 from the second CD row are equivalent to the dimensions of the holes 14 of the first row. Without desiring to be bound by theory, it is believed that the diameter of a respective hole 14, the CD and/or MD spacing of holes 14, the size (diameter) of the surface comprising holes 14, and/or the air pressure present within inner portion 16 applied to web material 12 through hole 14 can be effective to determine what diameter and spacing of holes 14 will provide optimal web handling, while reducing the effects of lateral contraction due to a tension T applied to web material 12. Likewise, it is believed that a web control device 10 having a larger surface (larger diameter) will require a higher number density of holes 14 present upon web control device 10. Further, one of skill in the art will appreciate that providing web control device 10 with first and second rows of holes 14 with vector components in any combination of the MD, CD, and z-directions, and by providing the surface of web control device 10 with a curvature suitable for handling a web substrate 12 can facilitate use of web control device 10 in consort with a dust capture apparatus (not shown) in order to capture debris released from web substrate 12 as discussed infra.

Figure 4:
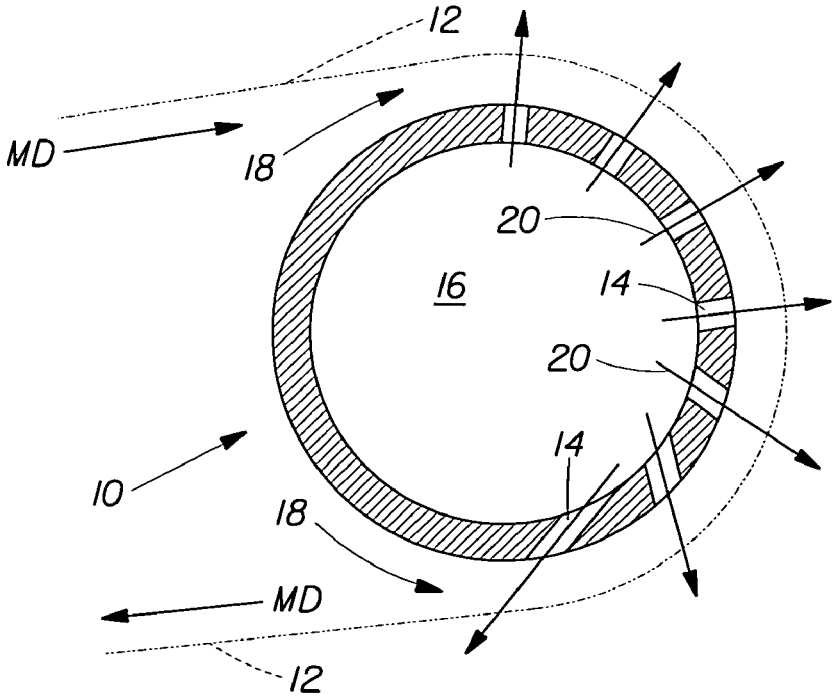
FIG. 4 is a cross-sectional view of an exemplary web control device.

As shown in FIG. 4, in yet another preferred embodiment, the longitudinal axis 20 of holes 14 can be provided in web control device 10 in order to provide a radial, or MD, component to a fluid exiting web control device 10 from inner portion 14 through hole 14. Thus, holes 14 can be provided with a longitudinal axis 20 that can direct fluid radially away from the surface of the web control device 10 as well as transverse to the MD of the web material 12. In other words, the longitudinal axis 20 of each hole 14 can be provided with vector components in any combination of the MD, CD, and z-directions.

Without desiring to be bound by theory, it is believed that providing the longitudinal axis 20 of holes 14 with a vector component in the MD can provide a MD thrust component to a web material 12 traversing proximate the outer portion 18 of web control device 10. It is believed that an MD momentum is transferred from the fluid to web material 12 though viscous coupling of the web to the air by providing holes 14 having a longitudinal axis 20 with a vector component in the MD. In a preferred embodiment, the thrust component is applied to web material 12 in the direction of web material 12 motion to overcome the effect of drag over the web handling device 10. Thus, any force vectoring in the MD can overcome the viscous form drag and add a motive force to the web material 12. Likewise, if more drag upon web material 12 is desired and/or required by the process, one of skill in the art will appreciate that the longitudinal axis 20 of holes 14 can be provided with a vector component in a direction opposing the MD of web material 12.

Figure 5:
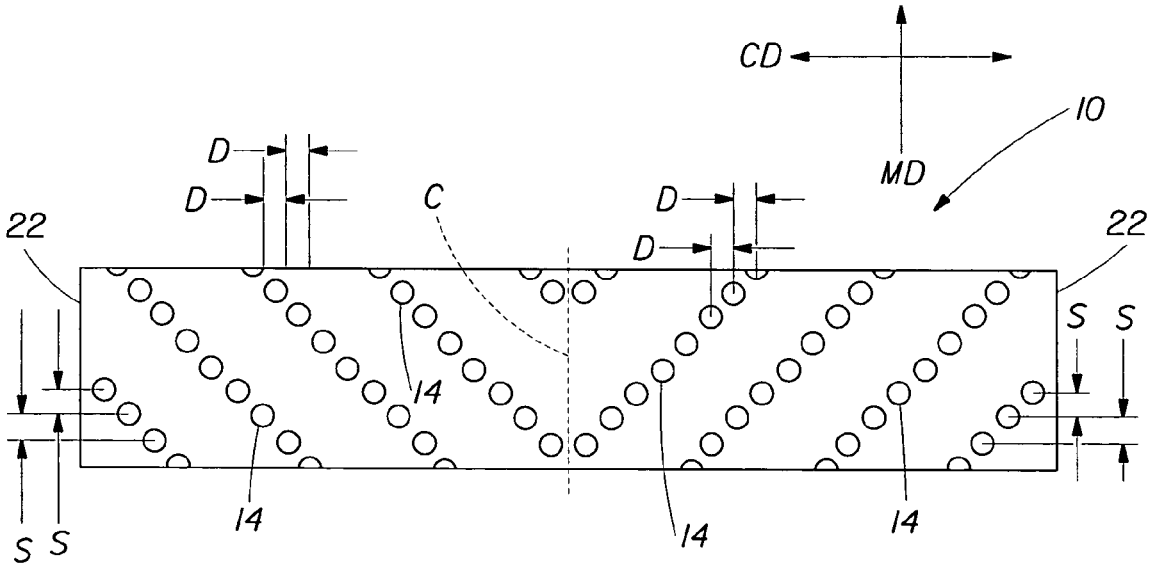
FIG. 5 is a plan view of an exemplary web control device.

As shown in FIG. 5, a preferred embodiment of web control device 10 provides each of the holes 14 in succeeding CD oriented rows with an advance of one hole 14 diameter D in the CD toward a respective edge 20 from centerline C of web control device 10. Additionally, each of the holes 14 in succeeding CD oriented rows are provided with a MD spacing S from an adjacent CD oriented row. The preferred embodiment shown in FIG. 5 provides for the progression of holes 14 in the CD with an identifiable pattern that repeats after an equivalent number of CD oriented rows equal to the hole 14 MD spacing S divided by the hole 14 diameter D. By way of example, providing holes 14 with a diameter D of 0.062 inches (1.57 mm) and a MD spacing S of 0.375 inches (9.53 mm), would provide for a pattern that repeats in the MD for every six rows of CD oriented holes. Without desiring to be bound by theory, it is believed that providing such a CD- and MD-oriented offset for holes 14 can provide for sufficient impingement of air upon web material 12 from web control device 10 to provide the aforementioned benefits to web material 12. However, one of skill in the art would be able to place each hole 14 upon the surface of web control device 10 in any pattern utilizing any diameter D of holes 14 at any CD and MD spacing at any number density required to provide the necessary, appropriate, and/or sufficient reduction to the effects of lateral contraction due to a tension T applied to web material 12 passing proximate to web control device 10. It is believed that providing an MD spacing S between successive CD oriented rows of holes 14 that advance one hole 14 diameter D in the CD toward a respective edge 20 from centerline C of the web control device 10 can provide web material 12 with an increased contact with a fluid transmitted from holes 14 as web material 12 traverses proximate to web control device 10. Thus, any lateral contraction due to an applied tension T to web material 12 is reduced and any resulting "corrugation" effects upon web material 12 due to the presence of high air jet forces acting on the same part of web material 12 by air handling devices already known in the art, are effectively eliminated. Thus, the fluid exiting each hole 14 can be provided with a higher jet velocity. Providing the fluid exiting each hole 14 with a higher jet velocity can increase the amount of fluid available to penetrate the web material 12 and reduce the amount of fluid reflected from impinging web material 12. In this way, drag upon web material 12 with respect to web control device 10 is increased thereby facilitating an increased control of web material 12 by web control device 10.

As would be known to one of skill in the art, a web material 12 can be produced from a papermaking machine or the like. The web material 12 produced from a former, through-air dryer, or pressing section, can be transported by a press felt or fabric to a press roll that transfers the web material 12 to a Yankee dryer roll. The web material 12 can then be brought into intimate engagement with the surface of a Yankee dryer whereby the web is rapidly dried by heat transfer from the dryer and from an air cap generally positioned over the top of the dryer. The resulting web material 12 can be scraped off the surface of the dryer by a doctor blade.

In a preferred embodiment, after the web material 12 is removed from the dryer surface by the doctor blade, the web control device 10 described herein can then be used to direct the web material 12 through a calendar. The web material 12 exiting such a calendar can then again be redirected by a second web control device 10 as described herein to a reel or winding device wherein the web material 12 is wound onto reels as would be known to those of skill in the art.

Figure 6:
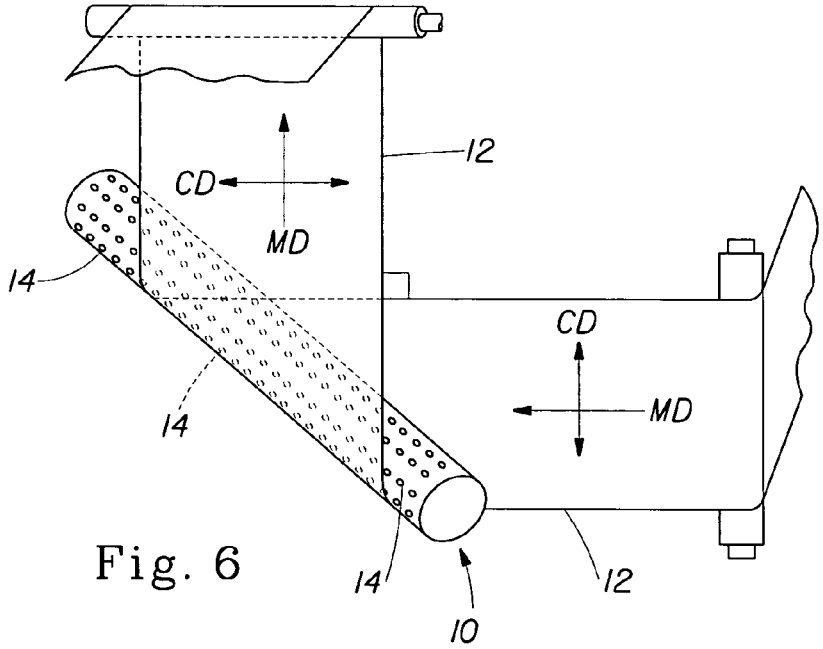
FIG. 6 is a perspective view of an exemplary alternative embodiment of a web control device in use; and, FIG. 7 is a plan view of an exemplary alternative embodiment of a web control device in use.

As shown in FIG. 6, an exemplary schematic plan view of the web control device 10 can be used to change the direction of web material 12 in a processing line. In this exemplary embodiment, the web material 12 is moving in a first direction prior to fluid contact proximate to the web control device 10. The web control device 10 can be provided with a longitudinal axis and positioned so that the longitudinal axis of the web control device 10 has an angular relationship to the directional movement of the web material 12. By way of non-limiting example, the longitudinal axis of web control device 10 can be provided at an angle of 45° relative to the machine direction of the web material 12. In this manner, the web control device 10 can redirect the web material 12 in a second direction of motion to further processing steps. In the above exemplary embodiment, the machine direction of web material 12 has been altered 90° from the machine direction of the web material 12 prior to contact with web control device 10 after proximate fluid contact with web control device 10.

Figure 7:
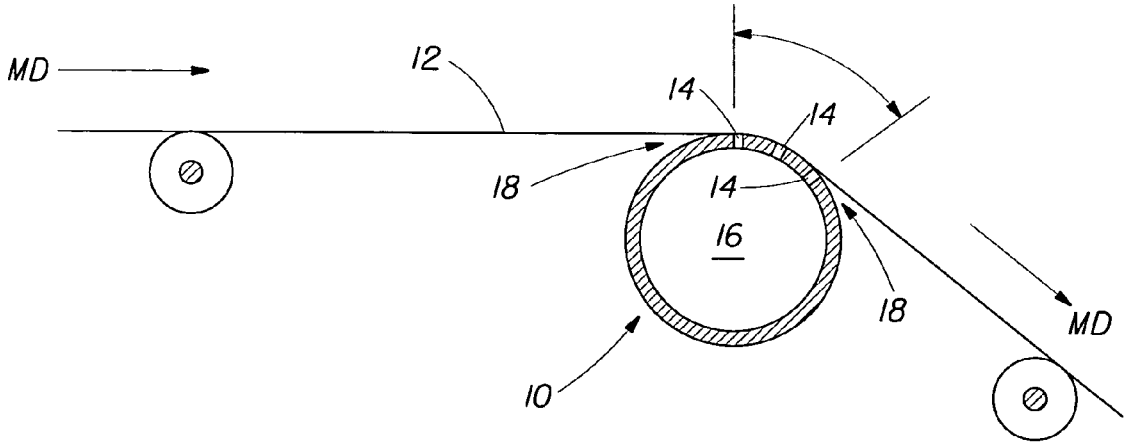

As shown in FIG. 7, web control device 10 can be provided to change the direction of web material 12 in a papermaking process. In this exemplary embodiment, the web material 12 can be provided with a first direction prior to proximate fluid contact with web control device 10. Web control device 10 can be provided with a longitudinal axis that is generally parallel to the cross-machine direction of the web material 12. Upon proximate fluid contact of the web material 12 with web control device 10, the direction of web material 12 can be altered to provide what is known to those of skill in the art as a "wrap angle." As would be known to those of skill in the art, a wrap angle can vary from about 0° to about 180° relative to the surface of web control device 10.

It is also believed that by providing holes 14 with a generally cylindrical geometry, a pressurized fluid contained within inner portion 16 of web control device 10 and transported to the outer portion 18 of web control device 10 through holes 14 can provide a uniform cushion pressure.

Thus, the web material 12 can be supported more uniformly and can maintain a more stable float condition. Such a cylindrical hole 14 design can allow for reduced pressure requirements and thus, reduced air supply fan horsepower, resulting in energy savings. Further, by providing rows of holes 14 that are collinear in the CD but not in the MD of web material 12, coated web materials 12 are not adversely affected with lane modeling of the wet coating or heat streaking due to the drying aspect of the high velocity of a cylindrical hole 14 discharge design. It is known that high-pressure hole discharge velocities from conventional designs on many lightweight web substrates can cause corrugation or fluttering within the web material 12. Providing holes 14 in an alternating pattern, as described herein, can provide for a lightweight web to remain substantially flat with substantially no flutter.

Pressurized gas, preferably air, can be supplied to the inner portion 16 of the web control device 10 by a suitable supply such as a fan. The inner portion 16 of web control device 10 is preferably in fluid communication with a cavity or plenum disposed within inner portion 16 of web control device 10. As would be known to those of skill in the art, a cushion pressure tap can be used to measure web support pressure. Fan supply pressure (the pressure from the fan that builds within the inner portion 16 of the web control device 10) can be measured as required. However, the air pressure can be provided as required and can depend upon the characteristics of the web material 12 and the configuration and design of the web control device 10 or any other web material 12 processing equipment being used.

For porous web materials 12, the impact of the fluid passing through the web material 12 can release debris (i.e., loose fibers, dust, lint, and the like), or cause debris to be released, from the region proximate to web material 12 or from the web material 12 itself. In this manner, web control device 10 can be used with, or be incorporated into, a dust capture apparatus (not shown). An exemplary, but non-limiting, embodiment of a dust capture device suitable for use with the web control device 10 of the present invention provides for the placement of a hood opposing the web control device 10 that can capture such debris released from web material 12 due to any impingement of fluid from web control device 10 upon web material 12. Additionally, individual web control devices 10 can be successively alternated above and below web substrate 12 in the MD in order to facilitate the removal of debris from both faces of web material 12. In any case, it has been surprisingly found that the amount of fluid exiting web control device 10 should equal the amount of fluid impinging a dust capture apparatus fluidly associated with web control device 10. This can result in an overall mass balance of fluid thereby increasing the control of web material 12 by web control device 10 and provide for the effective removal of debris from web material 12.

It should also be understood that the present invention is not limited to the particular construction and arrangement of components herein illustrated and described, but embraces such modified forms thereof as come within the scope of the following claims. For example, where reference is made to holes, slots could be used in place of holes.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An apparatus for reducing the Poisson lateral contraction in a web substrate proximate to said apparatus, said web substrate having a machine direction tension, the apparatus comprising:

a surface having a machine direction, a cross-machine directional orthogonal to said machine direction, and a z-direction orthogonal to both said machine direction and said cross-machine direction;

a plurality of holes disposed upon said surface, each of said holes being operatively connected to a source of positive pressure, said holes providing a fluid communication of said positive pressure through said surface to said web substrate proximate thereto;

wherein each of said holes has a longitudinal axis associated thereto;

wherein said longitudinal axis of a first of said holes has a first inclination relative to said z-direction;

wherein said longitudinal axis of a second of said holes has a second inclination relative to said z-direction;

wherein said longitudinal axis of a third of said holes has a third inclination relative to said z-direction;

wherein said first, second, and third inclinations are different; and, wherein said first, second, and third holes are spaced in said cross-machine direction.

2. The apparatus according to claim 1 wherein said apparatus has a longitudinal axis in said machine direction and an edge disposed distally therefrom, wherein said first hole is disposed proximate to said center and said third hole is disposed proximate to said edge, said second hole being disposed therebetween and wherein said first inclination is less than said third inclination.

3. The apparatus according to claim 2 wherein at least a portion of said first and second inclinations are directed in said cross-machine direction.

4. The apparatus according to claim 3 wherein at least a portion of said first and second inclinations are directed in said machine direction.

5. The apparatus according to claim 4 wherein said first inclination and said second inclination are directed toward a first edge of said web substrate.

6. The apparatus according to claim 1 wherein said first inclination and said second inclination are directed toward a first edge of said web substrate.

7. The apparatus according to claim 6 wherein said first inclination is less than said second inclination.

8. The apparatus according to claim 6 further comprising a fourth hole, said fourth hole being operatively connected to said source of positive pressure, said fourth hole providing a fluid communication of said positive pressure through said surface to said web substrate passing proximate thereto, said fourth hole having a fourth inclination relative to said z-direction.

9. The apparatus according to claim 8 wherein said inclination of said third hole and said inclination of said fourth hole are directed toward a second edge of said web substrate, said third inclination being less than said fourth inclination.

10. The apparatus according to claim 9 wherein said first, second, third and fourth holes are collinear in said cross-machine direction.

11. The apparatus according to claim 1 wherein said third hole is disposed distally from said first hole.

12. The apparatus according to claim 1 wherein said source of positive pressure is a plenum, said plenum being operatively connected to said surface.

13. An apparatus for reducing the Poisson lateral contraction in a machine direction moving web substrate, the apparatus comprising:

a surface having a machine direction, a cross-machine directional orthogonal to said machine direction, and a z-direction orthogonal to both said machine direction and said cross-machine direction;

a plurality of holes disposed collinearly relative to said cross-machine direction upon said surface, each of said holes being operatively connected to a source of positive pressure, said holes providing a fluid communication of said positive pressure through said surface to said web substrate passing proximate thereto;

wherein each of said holes has a longitudinal axis associated thereto;

wherein said longitudinal axis of a first of said holes has a first inclination relative to said z-direction;

wherein said longitudinal axis of a second of said holes has a second inclination relative to said z-direction;

wherein said longitudinal axis of a third of said holes has a third inclination relative to said z-direction;

wherein said first, second, and third inclinations are different and said third inclination is greater than said first and second inclinations;

said third hole being spaced from said first and second holes in said cross-machine direction; and, wherein said first, second, and third inclinations are directed toward a first edge of said web substrate.

14. An apparatus for reducing the Poisson lateral contraction in a machine direction moving web substrate, the apparatus comprising:

a surface having a machine direction, a cross-machine directional orthogonal to said machine direction, and a z-direction orthogonal to both said machine direction and said cross-machine direction;

a plurality of holes disposed upon said surface, each of said holes being operatively connected to a source of positive pressure, said holes providing a fluid communication of said positive pressure through said surface to said web substrate passing proximate thereto;

wherein each of said boles has a longitudinal axis associated thereto; wherein said longitudinal axis of a first of said holes has a first inclination relative to said z-direction;

wherein said longitudinal axis of a second of said holes has a second inclination relative to said z-direction;

wherein said longitudinal axis of a third of said holes has a third inclination relative to said z-direction;

wherein said first, second, and third inclinations are different;

said first and second holes being collinear relative to said cross-machine direction;

said third hole being spaced from said first and second holes in said machine direction; and, wherein said first, second, and third inclinations are directed toward a first edge of said web substrate.

15. The apparatus of claim 14 wherein at least a portion of said third inclination is directed in said machine direction.

* * * * *

UNITED STATES PATENT AND TRADEMARK OFFICE

CERTIFICATE OF CORRECTION

PATENT NO. : 7,311,234 B2
APPLICATION NO. : 11/145623
DATED : December 25, 2007
INVENTOR(S) : Solberg It is certified that error appears in the above-identified patent and that said Letters Patent is hereby corrected as shown below:

In Col. 6, line 9, the term "Holdovers" should be foldovers

Signed and Sealed this

Thirteenth Day of May, 2008

JON W. DUDAS
*Director of the United States Patent and Trademark Office*